United States Patent [19]

Frenier et al.

[11] Patent Number: 5,013,483

[45] Date of Patent: May 7, 1991

[54] PROCESS AND COMPOSITION FOR INHIBITING IRON AND STEEL CORROSION

[75] Inventors: Wayne Frenier, Tulsa; Fred Growcock, Broken Arrow; Victoria R. Lopp, Tulsa, all of Okla.; Brian Dixon, Holliston, Mass.

[73] Assignee: Dowell Schlumberger Incorporated, Tulsa, Okla.

[21] Appl. No.: 474,232

[22] Filed: Jan. 30, 1990

Related U.S. Application Data

[63] Continuation of Ser. No. 765,890, Aug. 14, 1985, abandoned.

[51] Int. Cl.[5] ..... C23F 11/10

[52] U.S. Cl. ..... 252/396; 252/8.555; 422/12

[58] Field of Search ..... 252/396 APS, 8.555 APS; 422/12

[56] References Cited

U.S. PATENT DOCUMENTS

| | | | |
|---|---|---|---|
| 3,077,453 | 2/1963 | Oakes | 252/389.51 X |
| 3,077,454 | 2/1963 | Monroe et al. | 252/148 |
| 3,107,221 | 10/1963 | Harrison et al. | 252/8.555 X |
| 3,382,179 | 5/1968 | Keeney et al. | 252/8.555 X |
| 3,404,094 | 10/1968 | Keeney | 252/8.555 X |
| 3,640,895 | 2/1972 | Foroulis | 252/8.555 X |
| 4,444,668 | 4/1984 | Walker et al. | 252/8.553 |
| 4,493,775 | 1/1985 | Coffey et al. | 252/8.55 C |
| 4,522,658 | 6/1985 | Walker | 252/8.553 |
| 4,552,672 | 11/1985 | Walker et al. | 252/8.553 |

FOREIGN PATENT DOCUMENTS

| | | | |
|---|---|---|---|
| 144663 | 6/1985 | European Pat. Off. | 252/396 |

OTHER PUBLICATIONS

Morrison and Boyd, *Organic Chemistry*, 4th Edition, Allyn and Bacon, 1983, p. 565.

*Patent Abstracts of Japan*, The Patent Office Japanese Government, vol. 3 (87), (C-53) (Jul. 25, 1979), for Kokai 54-66640.

*Patent Abstracts of Japan*, The Patent Office Japanese Government, vol. 6(11), (C-88) (Jan. 22, 1982), for 56-81685.

*Patent Abstracts of Japan*, The Patent Office Japanese Government, vol. 5 (15) (C-73) (Sep. 25, 1981), for 56-133471.

J. March, *Advanced Organic Chemistry*, 3rd Edition, pp. 683-684.

D. Noyce, et al., *J. Am. Chem. Soc.*, vol. 89, pp. 6225 to 6230 (1967).

D. Noyce, et al., *J. Am. Chem. Soc.*, vol. 90, pp. 1020 to 1022 (1968).

*Primary Examiner*—Robert L. Stoll
*Assistant Examiner*—Valerie Fee
*Attorney, Agent, or Firm*—Stephen A. Littlefield

[57] ABSTRACT

A composition and method for inhibiting corrosion of iron and steel in the presence of aqueous acid, especially concentrated hydrochloric acid comprising at least 5% by weight HCl, comprising an effective corrosion inhibiting amount of an alkenylphenone having the following structure:

(I)

wherein $R_1$ may be unsubstituted or inertly substituted aryl of 6 to about 10 carbons, and $R_2$ and $R_3$ may be the same or different and each may be hydrogen, halogen, or inertly substituted aliphatic of about 3 to about 12 carbons, and $R_2$ may also be alkanol, ether, or unsubstituted or inertly substituted aryl of 6 to about 10 carbons, provided that the total number of carbons in said alkenylphenone does not exceed 16, and preferably including a surfactant, and a process of using this composition.

25 Claims, 3 Drawing Sheets

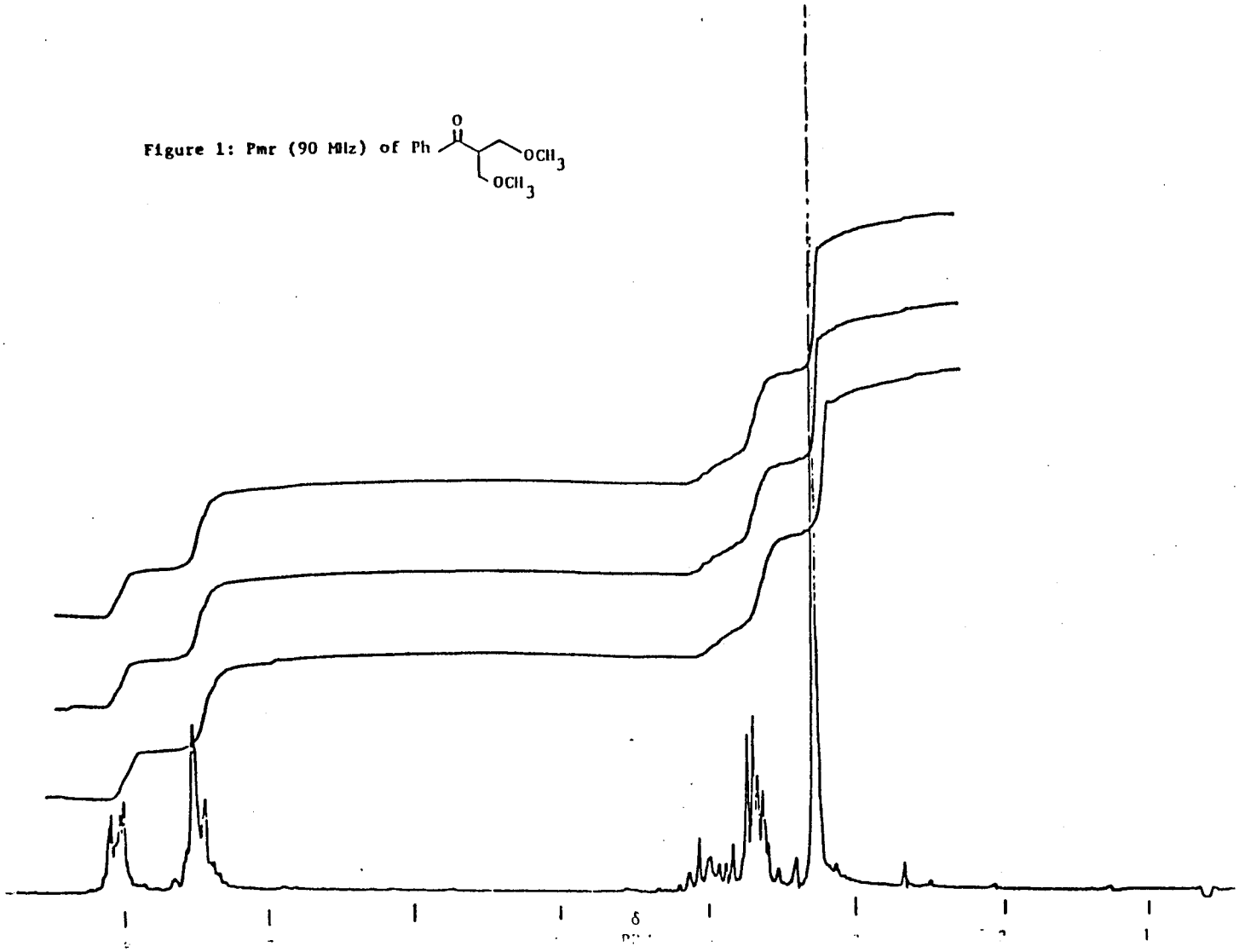
Figure 1: Pmr (90 MHz) of

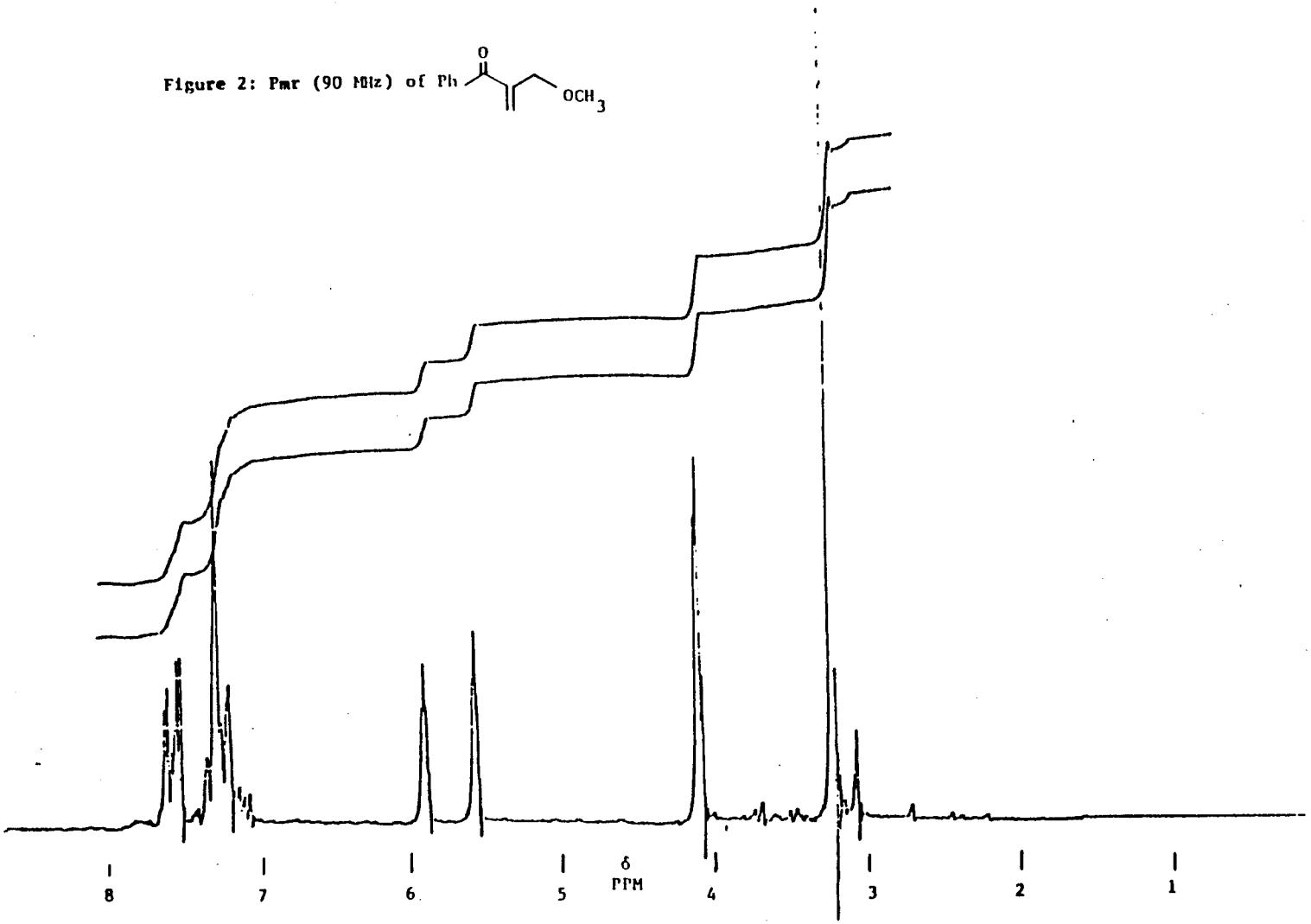
Figure 2: Pmr (90 MHz) of Ph

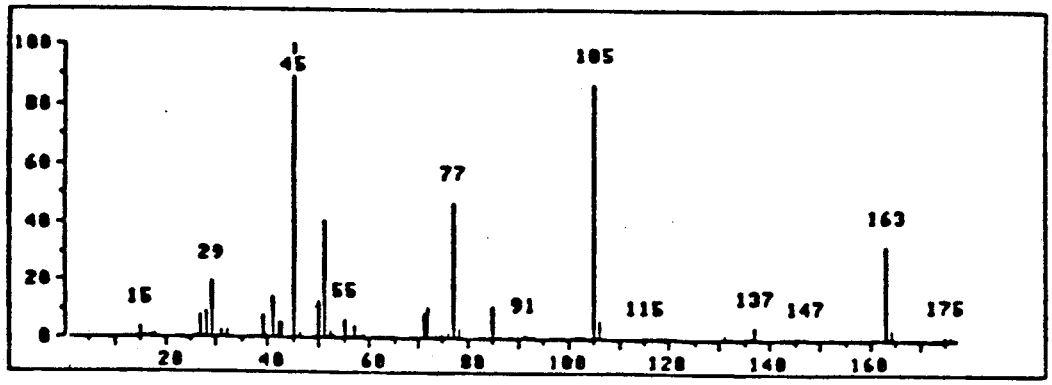
Figure 3: Mass Spectrum of Ph 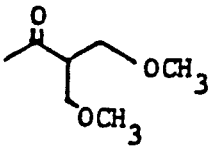
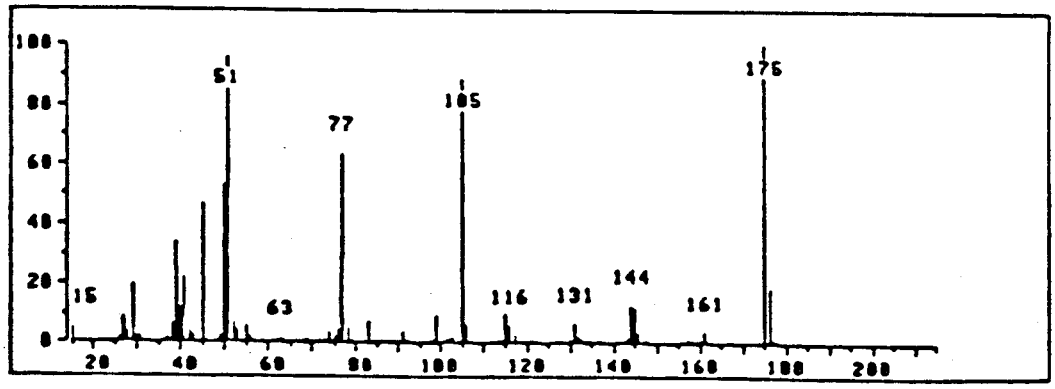
Figure 4: Mass Spectrum of Ph 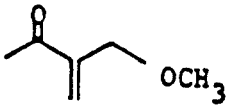

PROCESS AND COMPOSITION FOR INHIBITING IRON AND STEEL CORROSION

This application is a continuation of application Ser. No. 06/765,890, filed Aug. 14, 1985, now abandoned.

BACKGROUND OF THE INVENTION

1. Field of the Invention

The present invention relates to a new and useful class of corrosion inhibitors, and a process of using them. More particularly, the present invention concerns novel compositions of matter which reduce the attack of aqueous acid solutions on ferrous metals, and a process of using them.

2. Technology Review

In the exploration and recovery of oil from underground fields, it is common to "acidize" both new and producing wells with aqueous solutions of strong acids. Various inhibitors for preventing the attack of acids on ferrous metals have been proposed. Of the many inhibitors especially designed to prevent acid attack on the well casings, very few provide satisfactory protection. Arsenic and/or various arsenic compounds were used as corrosion inhibitors, despite their toxic effect. The toxic nature of arsenic and its compounds, and their adverse effect on catalysts used in petroleum refineries, have caused an extensive search for new corrosion inhibitors.

U.S. Pat. No. 3,077,454 discloses a class of inhibitors comprising certain active nitrogen-containing compounds combined with organic ketones and an aliphatic or aromatic aldehyde, capable of reducing aqueous acid attack on metals.

U.S. Pat. No. 4,493,775 discloses a formulation including (A) a reaction mixture prepared by reacting a formaldehyde component, an acetophenone component, a cyclohexylamine component and, optionally, an aliphatic carboxylic acid component, and (B) an acetylenic alcohol and excess (unreacted) formaldehyde. A $C_1$–$C_4$ alkanol, a surfactant, or other inert compound, may optionally be present in the formulation. The formulation is a corrosion inhibitor which is especially effective in sour wells, where hydrogen sulfide corrosion is a potential problem.

However, it would be desirable to have a corrosion inhibitor which is useful in a broader number of situations. For example, highly concentrated hydrochloric acid is often employed in oil well stimulation treatment, but its use can lead to severe corrosion problems. Thus it would be desirable to have a corrosion inhibitor composition which could inhibit the acid corrosion of ferrous metals even in the presence of concentrated hydrochloric acid, and which is compatible with a variety of additives, for example, surfactants.

SUMMARY OF THE INVENTION

The invention provides a composition and method for inhibiting the corrosion of iron and steel in the presence of aqueous acid, especially concentrated hydrochloric acid comprising at least 5 percent by weight HCl. The composition and method comprises adding to the acid an effective corrosion-inhibiting amount of an alkenylphenone having the following structure:

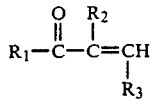

(I)

wherein $R_1$ may be unsubstituted or inertly substituted, aryl of 6 to about 10 carbons; and $R_2$ and $R_3$ may be the same or different and each be hydrogen, halogen, or an unsubstituted or inertly substituted aliphatic of about 3 to about 12 carbons. $R_2$ may also be an alkanol, an ether, or an unsubstituted or inertly substituted aryl of 6 to about 10 carbons. The total number of carbon atoms in the compound (I) should not exceed 16. Inert substituents by definition have no effect on the corrosion inhibition of the corresponding unsubstituted alkenylphenone and include, for example, lower alkyl (one to four carbons), halo, an ether, alkoxy, or nitro. The novel composition is preferably used in combination with a surfactant. The composition and method of the invention are surprisingly effective in inhibiting the corrosion of iron and steel over a broad range of hydrochloric acid concentration.

It is an object of the invention to provide an improved composition for inhibiting iron and steel corrosion caused by a corrosive aqueous fluid, comprising an aqueous acid an alkenylphenone of structure (I), and preferably including a surfactant.

It is another object of the invention to provide an improved method for inhibiting iron and steel corrosion caused by a corrosive aqueous fluid, comprising mixing a compound which in aqueous acid forms an effective corrosion-inhibiting amount of an alkenylphenone of structure (I), and preferably also including a surfactant, together with said corrosive aqueous fluid.

It is an advantage of the invention that the improved composition is surprisingly effective in inhibiting the corrosion of iron and steel over a broad range of acid concentrations.

It is another advantage of the invention that the improved method for inhibiting corrosion is especially effective in highly concentrated aqueous acid solutions.

It is a feature of the invention that compounds with diverse structures will form, in aqueous acid, an alkenylphenone of the structure (I).

It is another feature of the invention that compounds of the structure

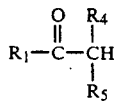

(II)

in aqueous acid form an alkenylphenone. In compounds of this structure, $R_4$ is an ether or alcohol of 0 to 8 carbon atoms in length, and $R_5$ is hydrogen, or an alkyl, alkenyl, alkynyl, cycloaliphatic or aryl group of 0 to 8 carbon atoms in length.

It is yet another feature of the invention that compounds of the structure

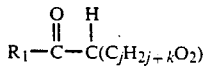

(III)

in aqueous acid, form an alkenylphenone. In compounds of this structure, (j) is an integer from 2 to 8, and (k) is an integer from 0 to 2.

BRIEF DESCRIPTION OF THE DRAWINGS

FIG. 1 illustrates the PMR spectrum of 2-benzoyl-1,3-dimethoxy propane.

FIG. 2 illustrates the PMR spectrum of 2-benzoyl-3-methoxy-1-propene.

FIG. 3 illustrates the mass spectrum of 2-benzoyl, 3-dimethoxy propane.

FIG. 4 illustrates the mass spectrum of 2-benzoyl-3-methoxy-1-propene.

DETAILED DESCRIPTION OF THE INVENTION

The corrosion inhibitors of the present invention may be formed in either of two ways: (A) the direct addition of an alkenylphenone to the corrosive aqueous fluid, preferably together with a surfactant; or (b) the addition of a precursor of an alkenylphenone which interacts with a corrosive aqueous acid fluid to form an alkenylphenone, preferably in the presence of a surfactant. Examples of alkenylphenones include:

(i) 2-benzoyl-3-hydroxy-1-propene

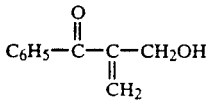

(ii) 2-benzoyl-3-methoxy-1-propene

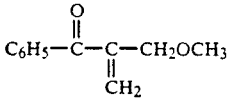

Precursors of alkenylphenones may take a variety of forms. Examples include:

(i) 5-benzoyl-1,3-dioxane

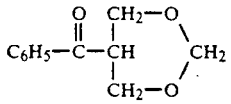

(ii) 2-benzoyl-1,3-dimethoxy-propane

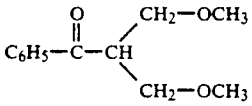

(iii) 3-hydroxy-1-phenyl-1-propanone

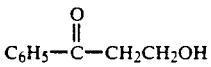

In 15% HCl at 65° C., (i) and (ii) form

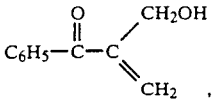

while (iii) forms

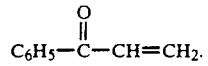

The corrosion inhibitors of the present invention may contain more than one precursor of an alkenylphenone. For example, the corrosion inhibitors of the present invention may include a mixture of precursors including an alpha-hydroxy vinylidene compound and a hydroxy ketone, preferably together with a surfactant. The alpha-hydroxy vinylidene compound has the form

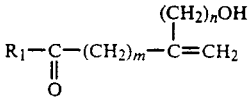

where $R_1$ may be an aryl hydrocarbon or inertly substituted aryl hydrocarbon: m and n must each be less than 5, and the total number of carbons in the compound should be 16 or less. A preferred example of an alpha-hydroxy vinylidene compound is 2-benzoyl-3-hydroxy-1-propene.

The hydroxy ketone has the form

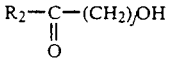

where $R_2$ may be an aryl hydrocarbon or inertly substituted aryl hydrocarbon. The value of j must be less than 5, and the compound should contain not more than 16 carbon atoms. A preferred example of a hydroxy ketone is 3-hydroxy-1-phenyl-1-propanone.

The compositions of the present invention comprise an alkenylphenone of the structure (I). In addition, the composition preferably contains a surfactant in an amount from 0 to about 2% by weight, based on the weight of the entire composition. The surfactant may be chosen from nonionic, cationic, anionic or amphoteric surface active agents. An example of a nonionic surfactant is "THEO", an adduct of trimethyl-1-heptanol with 7 moles of ethylene oxide. An example of a cationic surfactant is "DDPB", dodecylpyridinium bromide. An example of an anionic surfactant is disodium 4-decylated oxydibenzenesulfonate. An example of an amphoteric surfactant is coco beta-amino propionate.

Finally, the compositions of the invention include at least one of the following:

(1) Non-oxidizing mineral or organic acids, for example hydrochloric acid, hydrofluoric acid, sulfuric acid, phosphoric acid, formic acid, acetic acid, citric acid, and mixtures thereof. The acid solutions may optionally contain chelating agents such as EDTA. The concentration of a non-oxidizing mineral or organic acid in the composition of the present invention may vary from about 0.1 to about 35% by weight based on the entire weight of the composition.

(2) An alkaline chelating agent, such as the ammonium salts of EDTA, HEDTA, and DPTA. Alkaline chelating agents may be present in the composition of the present invention in an amount from about 0.1 to about 15% by weight, based on the weight of the entire composition.

(3) Salt solutions, such as, solutions of sodium chloride, potassium chloride, calcium chloride, calcium bromide, zinc bromide and mixtures thereof. Concentrations of salt solutions in the compositions of the present invention may vary from about 0.1% by weight to saturation, based on the weight of the entire composition.

(4) A salt solution, as described above, may be mixed with an acid gas, such as carbon dioxide or hydrogen sulfide, and/or hydrocarbons such as mineral oil, crude oil and refined hydrocarbon products.

The amount of an alkenylphenone in the composition of the present invention may vary from about 0.01% to about 2% by weight, based on the weight of the entire composition. The compositions of the present invention may be used for acidizing hydrocarbon producing agents, cleaning metal, or completing oil and gas wells.

The present invention also includes a process for inhibiting the corrosion of iron and steel caused by corrosive aqueous acids, especially concentrated hydrochloric acid comprising at least 5 percent by weight HCl. The process is performed by introducing an effective corrosion inhibiting amount of an alkenylphenone or an alkenylphenone precursor into a corrosive aqueous acid. As discussed above, the alkenylphenone precursor can be selected from any material which generates structure (I) when brought into contact with an aqueous fluid. In many cases, the inhibition of the present process is enhanced by the addition of from about 0.01 to about 2% by weight, compared to the weight of the entire composition, of a surfactant, selected from the surface active agents discussed above. The process of the present invention is normally practiced from about 20° C. to about 200° C. In the process of the present invention, the inhibitor composition is usually about 0.1 to about 4% by weight compared to the weight of aqueous fluid. The total amount of inhibitor compositions used in the process will depend on the corrosive aqueous acid, its temperature and intended time of contact. The ratio of surfactant to inhibitor composition will depend on the corrosive aqueous fluid, and the water solubility of the inhibitor composition. The exact amounts are determined using the test methods described in the examples below.

EXAMPLES

In order that those skilled in the art may better understand how the present invention may be practiced, the following Examples are given by way of illustration and not by way of limitation. All parts and percentages are by weight, unless otherwise noted.

EXAMPLE 1

Preparation of 2-Benzoyl-1,3-Dimethoxy Propane:

The condensation procedure described by Fuson, Ross and McKeever in *J. Am Chem. Soc.*, Vol. 60, page 2935 (1938) for formaldehyde and acetophenone was modified as follows. Acetophenone (180 g, 1.5 mol), and paraformaldehyde (45 g, 1.5 mol) were dissolved in 150 ml of $CH_3OH$. $K_2CO_3$ (2 g, $1.5\times10^{-3}$ mol) was added and the solution stirred at 25° C. for 64 hr. The solution was then acidified to pH=2 with 10% HCl and the $CH_3OH$ was removed in vacuo. The resulting orange liquid was then distilled in two fractions at 0.2–0.3 mm. Fraction #1 was residual acetophenone.

Fraction #2 distilled at 87°–90°, 0.25 mm. The latter fraction was then distilled again giving an 87% yield of a mixture of 1 and 2 (of which 88% was the desired dimethyl diether 1). Spectral assignments were as follows: PMR ($CDCl_3$) see FIG. 1: 3.20 (s, methoxy, 6H), 3.5–3.75 (m, xethylene, 4H), 3.8–4.1 (m, methine, 1H), 7.2–8.1 (m, aromatic 5H). Gas chromatographies were run on a Hewlett-Packard Model 5710 Flame Ionization Gas Chromatograph equipped with a 30 m capillary column coated with DB-5; $T_1=100°$ programmed at 32° C./min to 220° C. (8 min);

T(inj)=T(det)=250° C. Flow rate: 42 ml/min; Ret times (min): diether 1 3.30; monoether 2, 3.41.

Mass spectra were obtained on a Hewlett-Packard Model 5985 GC/MS system equipped with a 50 m capillary column coaterd with SP-2100. Pmr spectra (90 mHz) were obtained on a Varian Model EM-390 spectrometer. m/e (%); see FIG. 3:=176 (1.5), 175 (1.5), 164 (4.7), 163 (38.0), 106 (7.5), 105 (100), 85 (12), 77 (49.1) 72 (11.5), 71 (9.2), 55 (6.2), 50 (10.9), 45 (91.0), 41 (11.9), 29 (14.9).

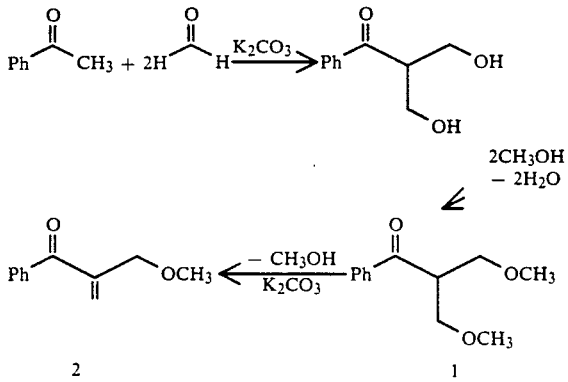

EXAMPLE 2

Preparation of 2-Benzoyl-3-Methoxy-1-Propene:

An 84 g sample of 91% pure 2-benzoyl-1,3-dimethoxy propane 1 was heated with 4.2 g (5 wt %) of p-toluene sulfonic acid (p-TSA) to 80° with stirring. After 5 hr. a second 4.2 g sample of p-TSA was added. A third p-TSA addition of 2 g was made after another 5 hr. This mixture was left stirring for 6.5 hrs longer and then cooled. The reaction mixture was diluted with ml of $Et_2O$ and 100 ml $H_2O$ added. This mixture was then neutralized to pH=6–7 with dilute $Na_2CO_3$ and the organic layer dried over $MgSO_4$. Filtration and removal of the ether in vacuo left an orange liquid, 2, which was distilled at 0.1 mm and 76° C. Yield: 73%. Purity: 93%.

Spectral assigments were as follows: Pmr ($CDCl_3$) see FIG. 2: 3.35 (s, methoxy, 3H), 4.3 (s, methylene, 2H), 5.7 (m, vinyl, 1H), 6.1 (m, vinyl, 1H), 7.2–8.0 (m, aromatic, 5H). m/e (%) see FIG. 4:=176 (18.7), 175 (100), 145 (12.2), 144 (12.6), 115 (9.6), 105 (88.5), 99 (9.5), 77 (63.1), 51 (96.6), 50 (53.3), 45 (47.0), 41 (22.0), 40 (12.0), 39 (34.1), 29 (19.7).

EXAMPLE 3

API Grade J55 coupons were cleaned in an ultrasonic cleaner containing a chlorinated hydrocarbon solvent, lightly scrubbed with a steel wool pad and water, rinsed with acetone, dried and weighed. The coupons were suspended from glass hooks attached to the lids of 4-oz. bottles and immersed in 100 mL of 15% HCl, whereupon they were heated to 65° C. and maintained at that temperature for 24 hours. After the test, the coupons were cleaned and weighed as before. The corrosion rate was calculated from the change in weight over the test period using the following formula:

$$R(\text{lb/ft}^2\text{-day}) = \frac{49.15 \times W(\text{g})}{t(\text{hr}) \times A(\text{cm}^2)}$$

where A, the surface area of the coupons, was taken to be 25.0 $cm^2$. The corrosion rate measured for the uninhibited acid was 1.03 lb/$ft^2$-day. When 0.20 g of 2-benzoyl-3-hydroxy-1-propene and 0.05 g of the adduct of trimethyl-1-heptanol with 7 moles of ethylene oxide were added prior to a test, the corrosion rate was reduced to 0.0090 lb/$ft^2$-day. The % protection was $$P = \frac{\text{Rate } w/o \text{ Inh.} - \text{Rate } w/\text{Inh.}}{\text{Rate } w/o \text{ Inh.}} \times 100 = 99.1\%$$

EXAMPLE 4

Effect of Surfactant

The effect of surfactant on the ability of the claimed inhibitors to inhibit the corrosion of J55 steel in 15% in HCl is shown below. The test sequence is the same as in Example 3.

| | 24-hour Tests 15% HCl, 65° C. J55 (D), S/V = 0.25 % Protection[a] | | |
|---|---|---|---|
| Inhibitor | Neat | W/THEO[b] | W/DDPB[b] |
| 2-benzoyl-3-hydroxy-1-propene | 91.6 | 99.1 | 98.5 |
| 2-benzoyl-3-methoxy-1-propene | 94.7 | 99.0 | 98.8 |
| 5-benzoyl-1,3-dioxane | 56.6 | 84.0 | 94.5 |
| 2-benzoyl-1,3-dimethoxy-propane | 60.4 | 90.7 | 97.5 |
| 3-hydroxy-1-phenyl-1-propanone | 0 | 98.8 | 98.5 |

[a][Inhibitor] = 0.20 g/100 mL, [Surfactant] = 0.05 g/100 mL.
[b]THEO = adduct of trimethyl-1-heptanol with 7 moles ethylene oxide.
DDPB = dodecylpyridinium bromide.

EXAMPLE 5

Effect of HCl Concentration

The effect of acid concentration on the effectiveness of the claimed inhibitors is shown below. The test sequence is the same as that described in Example 3.

| | 24-Hour Tests 65° C., J55 (D), S/V = 0.25 % Protection | | | |
|---|---|---|---|---|
| | 15% HCl[a] | | 28% HCl[b] | |
| Inhibitor | W/ THEO | W/ DDPB | W/ THEO | W/ DDPB |
| 2-benzoyl-3-hydroxy-1-propene | 99.2 | 98.5 | 99.3 | 99.1 |
| 2-benzoyl-3-methoxy-1-propene | 99.0 | 98.8 | 99.2 | 99.0 |
| 5-benzoyl-1,3-dioxane | 84.0 | 94.5 | 98.9 | 98.6 |
| 2-benzoyl-1,3-diethoxy propane | 90.7 | 97.5 | 99.1 | 99.1 |

[a][Inhibitor] = 0.20 g/100 mL, [Surfactant] = 0.05 g/100 mL.
[b][Inhibitor] = 0.40 g/100 mL, [Surfactant] = 0.10 g/100 mL.

It is understood that various other modifications will be apparent to and can readily be made by those skilled in the art without departing from the scope and spirit of the invention. Accordingly, it is not intended that the scope of the claims appended hereto be limited to the description as set forth herein, but rather that the claims be construed as encompassing all the features of patentable novelty which reside in the present invention, including all features which would be treated as equivalents thereof by those skilled in the art to which this invention pertains.

What is claimed is:

1. A method for forming an alkenylphenone corrosion inhibiting composition comprising the steps of:

providing a precursor compound having the structure

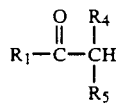

wherein $R_1$ is an unsubstituted or inertly substituted aryl of 6 to about 10 carbons; $R_4$ is an ether or alcohol or 0 to 8 carbon atoms in length, and $R_5$ is hydrogen, or an alkyl, alkenyl, alkynyl, cycloaliphatic or aryl group of 0 to 8 carbon atoms in length; and reacting the precursor compound with an aqueous acid to form an alkenylphenone composition.

2. The method of claim 1, wherein the precursor is 3-hydroxy-1-phenyl-1-propanone.

3. The method of claim 1, further comprising the step of adding from about 0 to about 2% by weight of a surfactant to the alkenylphenone composition.

4. The method of claim 1, wherein the aqueous acid comprises from about 0.1 to about 35% by weight of the alkenylphenone composition.

5. The method of claim 4, wherein the aqueous acid is selected from the group consisting of hydrochloric acid, hydrofluoric acid, sulfuric acid, phosphoric acid, formic acid, acetic acid, citric acid, and mixtures thereof.

6. The method of claim 1, further comprising the step of adding from about 0.1 to about 15% by weight of an alkaline chelating agent to the alkenylphenone composition.

7. The method of claim 6, wherein the alkaline chelating agent is selected from the group consisting of the ammonium salts of EDTA, HEDTA, and DPTA.

8. The method of claim 1, further comprising the step of adding from about 0.1% by weight to saturation of a salt solution to the alkenylphenone composition.

9. The method of claim 8, wherein the salt solution is selected from the group consisting of solutions of sodium chloride, potassium chloride, calcium chloride, calcium bromide, zinc bromide and mixtures thereof.

10. The method of claim 8, further comprising mixing at least one of the group consisting of an acid gas and a hydrocarbon with the salt solution.

11. The method of claim 1, wherein the alkenylphenone comprises about 0.1% to about about 2% by weight of the composition formed.

12. A method for forming an alkenylphenone corrosion inhibiting composition comprising the steps of:

providing a precursor compound having the structure

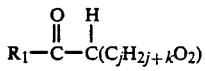

wherein $R_1$ is an unsubstituted or inertly substituted aryl of 6 to about 10 carbons; (j) is an integer from 2 to 8, and (k) is an integer from 0 to 2;. and reacting the precursor compound with an aqueous acid to form an alkenylphenone composition.

13. The method of claim 12, wherein the precursor compound is 5-benzoyl-1,3-dioxane.

14. The method of claim 12, wherein the precursor is 2-benzoyl-1,3-dimethoxy-propane.

15. The method of claim 12, further comprising the step of adding from about 0 to about 2% by weight of a surfactant to the alkenylphenyl composition.

16. The method of claim 12, wherein the aqueous acid comprises from about 0.1 to about 35 % by weight of the alkenylphenone composition.

17. The method of claim 16, wherein the aqueous acid is selected from the group consisting of hydrochloric acid, hydrofluoric acid, sulfuric acid, phosphoric acid, formic acid, acetic acid, citric acid, and mixtures thereof.

18. The method of claim 12, further comprising the step of adding from about 0.1 to about 15% by weight of an alkaline chelating agent to the alkenylphenone composition.

19. The method of claim 18, wherein the alkaline chelating agent is selected from the group consisting of the ammonium salts of EDTA, HEDTA, and DPTA.

20. The method of claim 12, further comprising the step of adding from about 0.1% by weight to saturation of a salt solution to the alkenylphenone composition.

21. The method of claim 20, wherein the salt solution is selected from the group consisting of solutions of sodium chloride, potassium chloride, calcium chloride, calcium bromide, zinc bromide and mixtures thereof.

22. The method of claim 21, further comprising mixing at least one of the group consisting of an acid gas and a hydrocarbon with the salt solution.

23. The method of claim 12, wherein the alkenylphenone comprises about 0.01% to about about 2% by weight of the composition formed.

24. A composition, in the presence of an aqueous acid, consisting essentially of:

an alkenylphenone of the structure:

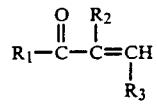

(I)

wherein $R_1$ may be unsubstituted or inertly substituted aryl of 6 to 10 carbons, and $R_2$ and $R_3$ may be the same or different and each may be hydrogen, halogen, or inertly substituted aliphatic of about 3 to about 12 carbons, and $R_2$ may also be alkanol, ether, or unsubstituted or inertly substituted aryl of 6 to about 10 carbons, provided that the total number of carbons in said alkenylphenone does not exceed 1, said alkenylphenone being made by a method comprising the steps of:

providing a precursor compound having the structure

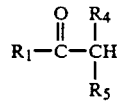

wherein $R_4$ is an ether or alcohol of 0 to 8 carbon atoms in length, and $R_5$ is hydrogen, or an alkyl, alkenyl, alkynyl, cycloaliphatic or aryl group of 0 to 8 carbon atoms in length; and reacting the precursor compound with aqueous acid to form said alkenylphenone.

25. A composition, in the presence of an aqueous acid, consisting essentially of:

an alkenylphenone of the structure:

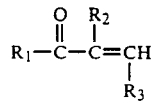

(I)

wherein $R_1$ may be unsubstituted or inertly substituted aryl of 6 to about 10 carbons, and $R_2$ and $R_3$ may be the same or different and each may be hydrogen, halogen, or inertly substituted aliphatic of about 3 to about 12 carbons, and $R_2$ may also be alkanol, ether, or unsubstituted or inertly substituted aryl of 6 to about 10 carbons, provided that the total number of carbons in said alkenylphenone does not exceed 1, said alkenylphenone being made by a method comprising the steps of:

providing a precursor compound having the structure

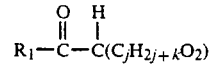

wherein (j) is an integer from 2 to 8, and (k) is an integer from 0 to 2; and reacting the precursor compound with aqueous acid to form said alkenylphenone.

* * * * *